US006866403B1

(12) United States Patent
Schaak

(10) Patent No.: US 6,866,403 B1
(45) Date of Patent: Mar. 15, 2005

(54) LIPSTICK LAMP

(75) Inventor: Amanda L. Schaak, Dix Hills, NY (US)

(73) Assignee: Adesso Inc., New York, NY (US)

( * ) Notice: Subject to any disclaimer, the term of this patent is extended or adjusted under 35 U.S.C. 154(b) by 0 days.

(21) Appl. No.: 10/422,549

(22) Filed: Apr. 24, 2003

(51) Int. Cl.[7] ..... F21V 1/10

(52) U.S. Cl. ..... 362/284; 362/35; 362/220; 362/223; 362/270; 362/282; 362/285; 362/361; 362/413; 362/419; 362/428; 362/806

(58) Field of Search ..... 362/284, 35, 153, 362/220, 223, 270, 282, 285, 311, 361, 410, 413, 419, 428, 806

(56) References Cited

U.S. PATENT DOCUMENTS 4,291,365 A * 9/1981 Tandon et al. ..... 362/281
4,504,890 A 3/1985 Chan ..... 362/203
4,888,667 A 12/1989 Hwang ..... 362/109
5,045,986 A 9/1991 Lin ..... 362/413
5,235,500 A 8/1993 Sapper ..... 362/426
6,450,672 B2 9/2002 Gismondi ..... 362/427

* cited by examiner

*Primary Examiner*—Stephen Husar
*Assistant Examiner*—Sharon Payne
(74) *Attorney, Agent, or Firm*—Darby & Darby

(57) ABSTRACT

A lamp for use on a table or a floor comprises a base, an intermediate spacer coupled to the base and rotatable with respect thereto, a light source, and a shade disposed over and about the light source. The shade has a surface shaped to insinuate a lipstick and additionally has a partially translucent portion acting to diffuse light emanating from the lamp. The lamp operates such that rotation of the intermediate spacer causes the lamp shade to move along a linear axis. A method for adjusting the light pattern emanating from such a lamp further comprises energizing the light source, rotating the intermediate spacer, and moving the shade along the linear axis while maintaining the light source energized.

12 Claims, 2 Drawing Sheets

LIPSTICK LAMP

FIELD OF INVENTION

The present invention relates to table and floor lamps and, more particularly, to a table or floor lamp shaped to insinuate a lipstick.

BACKGROUND OF THE INVENTION

A variety of decorative adjustable table and floor lamps are known in the art yet there remains room for improvements.

The closest art of record, U.S. Pat. No. 4,504,890 issued to Chan, describes a pocket-sized, battery-operated flashlight that resembles a lipstick. The flashlight has an exposed bulb that moves axially between a fully retracted position and a fully projected position in response to the rotation of the housing. The flashlight illuminates only when the bulb is fully projected and provides directed light in an axial direction.

It would be desirable to have a decorative table or floor lamp which operates in a manner similar to a lipstick container yet which provides a lighting arrangement appropriate for general interior use. The present invention satisfies this and other needs.

SUMMARY OF THE INVENTION

In accordance with one aspect of the invention, there is provided a lamp for use on a table or floor having a base, an intermediate spacer coupled to the base and rotatable with respect thereto, a light source, and a shade disposed over and about the light source. The shade has a surface shaped to insinuate a lipstick and also has a partially translucent portion that acts to diffuse light emanating from the lamp. The lamp also has a coupling within the spacer such that rotation of the intermediate spacer causes the shade to move along a linear axis.

In accordance with a second aspect of the invention, there is provided a method for adjusting a light pattern emanating from a lamp. The method includes the steps of: (i) providing a lamp having a base, an intermediate spacer rotatably coupled to the base, a light source, a shade having a surface shaped to insinuate a lipstick, and a coupling within the intermediate spacer such that rotation of the intermediate spacer causes the shade to move along a linear axis, (ii) energizing the lamp, (iii) rotating the intermediate spacer, and (iv) moving the shade along a linear axis while the light source is maintained energized such that the light pattern emanating from the lamp is adjusted.

These and other aspects, features, and advantages of the present invention will be apparent from the accompanying Drawings and Description of the Preferred Embodiment.

DETAILED DESCRIPTION OF THE PREFERRED EMBODIMENTS

Figure 1:
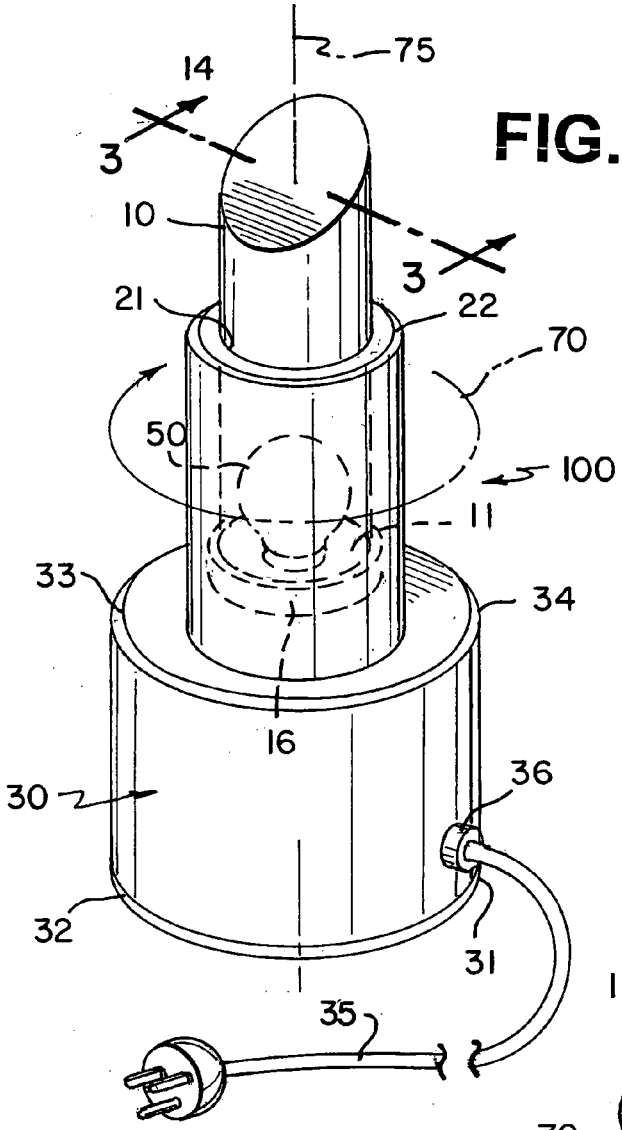
FIG. 1 is a perspective view illustrating the outer configuration of a lipstick lamp with the shade in a retracted position according to an embodiment of the present invention.

By way of overview and introduction, a lipstick lamp 100 in accordance with a first embodiment of the invention is illustrated. First referring to FIG. 1, the lamp 100 is shown with a shade 10 in a retracted position. The lamp 100 broadly encompasses a base 30, an intermediate spacer 20, a shade 10, and a light source 50. The intermediate spacer 20 is rotatable along an axis of rotation 70 and the shade 10 is moveable along a linear axis 75 in response to the rotation of the spacer 20. Referring now to FIG. 2, the lamp 100 is shown with the shade 10 in a projecting position in response to rotation of the spacer 20.

Figure 3:
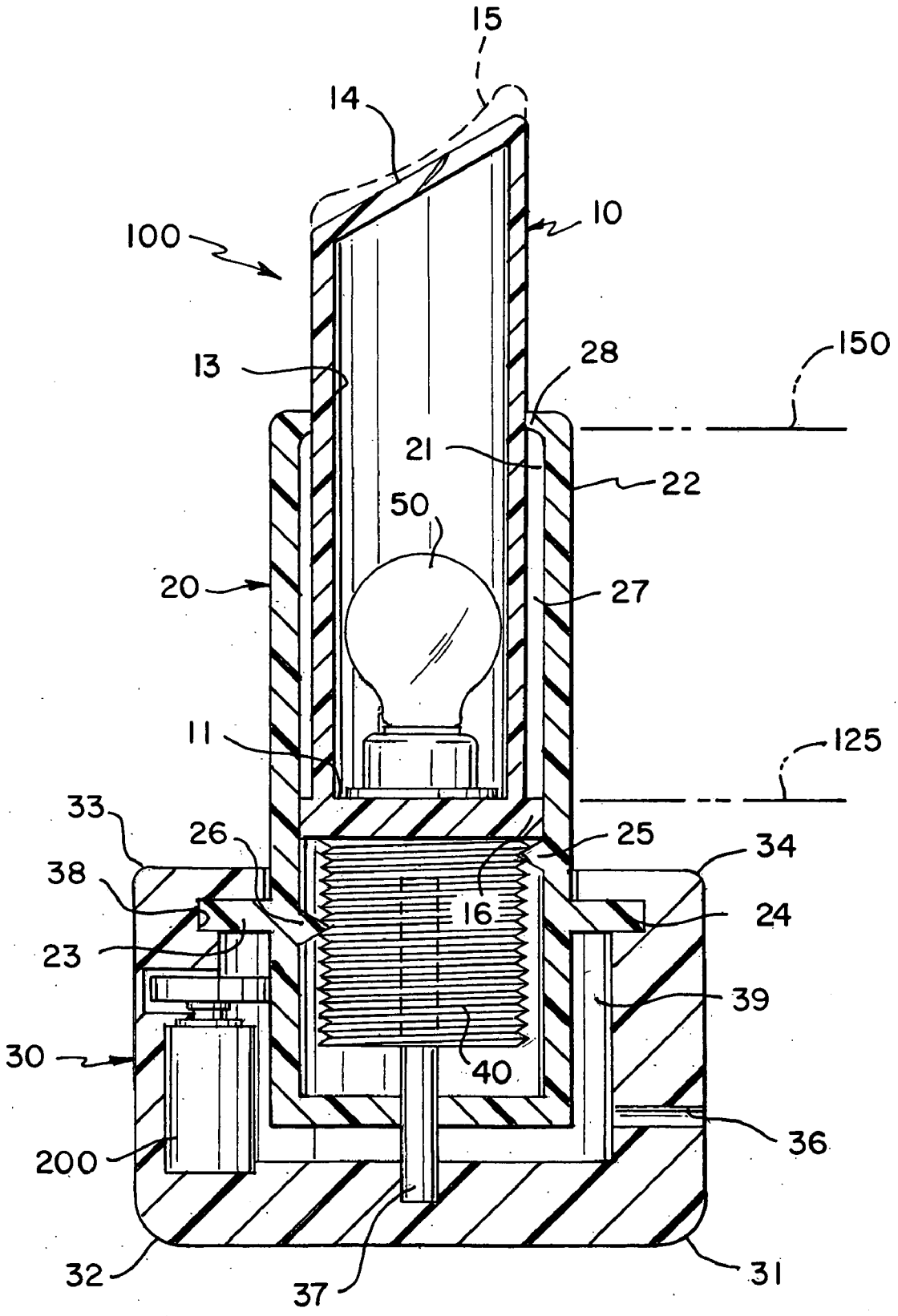
FIG. 3 is an axial section taken along Line 3—3 of FIG. 2.

The base 30 is preferably cup-like in shape, that is, it defines an open top container, and is preferably made from molded plastic. Other materials generally used in the fabrication of lamps, such as any of a variety of metals, may also be used. As shown in FIG. 3, the base 30 includes a cavity 39 sized to receive an intermediate spacer 20 and to allow the spacer 20 to freely rotate within the base 30. Preferably, the base further defines an annular channel 38 that receives fingers or posts 23, 24 protruding from the outer edge 22 of the spacer 20. The base also includes a projecting element 37 which connects to a coupling 40 such that the coupling 40 is restrained but can still move along a linear axis 75 relative to the base 30. While the posts 23, 24 and channel 38 interlock to provide an assembly that permits the spacer 20 to rotate relative to the base 30 in the illustrated embodiments, other mechanical arrangements can alternatively be provided to create this assembly.

In the preferred embodiment, the base 30 also incorporates a through-hole 36 through which a power cord 35 passes into the interior of the lamp 100 so as to electrically connect a power source (not shown) to the light source 50, and so as to not be affected by the rotation of the spacer 20.

In the illustrated embodiments, the base 30 has outside contours 31-34 that are slightly rounded to emulate the appearance of a base of a traditional lipstick applicator. In another embodiment, the outside contours 31-34 are square. The overall size and dimensions of the base 30 are chosen so as to form the appearance of a traditional lipstick applicator and lipstick when combined with the other elements of the lamp. The base 30 is of sufficient weight to adequately support the remaining elements of the lamp on a surface such as a table or a floor without tipping. The amount of weight required by the base 30 is defined by the overall size of the constructed lamp as well as the overall relation of the individual elements of the lamp relative to one another.

The lamp 100 also includes an intermediate spacer 20. The spacer 20 is a tubular body that has an inner surface 21 and an outer surface 22. In one embodiment, the intermediate spacer 20 is rotatably coupled to the base 30 through the interaction of a channel 38 formed in the base and posts 23, 24 protruding from the outer edge 22 of the spacer 20 so as to the allow the spacer 20 to freely rotate in either a clockwise or counter-clockwise direction along a plane of rotation 70 relative to the base 30. These elements additionally restrain the spacer 20 so as to allow little or no movement relative to the base 30 along an axial direction 75. Preferably, spacer 20 has a through-hole (not shown) through which the power cord 35 passes so as to electrically connect a power source (not shown) to the light source 50.

The inner surface 21 of the spacer 20 further preferably includes posts 25, 26 or some type of threading (not shown) which protrude from the inner surface 21. In such an embodiment, the posts 25, 26 interact with the coupling 40 so as to impart a linear motion along the axis 75 to the coupling 40 in response to a rotation of the spacer 20 by a user. According to another embodiment, this interaction imparts a linear motion along the axis 75 to the coupling 40 in response to the rotation of the spacer 20 by a motor (not shown). The coupling 40 can be formed in any of a variety of other ways to covert the rotation of the spacer 20 into linear motion.

The inner surface 21 of the spacer 20 further preferably includes an annular lip 28 which restrains a flange 16 extending from the lower surface 11 of the shade 10 when the shade 10 is extended to a maximum position away from the base 30 along the axis 75. In this way, the lip 28 restrains the shade 10 and prevents the shade 10 from extending entirely through the spacer 20 as it is raised along the axis 75.

Preferably, the spacer 20 is made from molded plastic, but it may also be made from any of a variety of materials which are known and utilized in the fabrication of lamps. Preferably, the spacer 20 is made of the same material used to construct the base 30. In one embodiment, the base 30 is constructed from metal and the spacer 20 is constructed from plastic.

Figure 2:
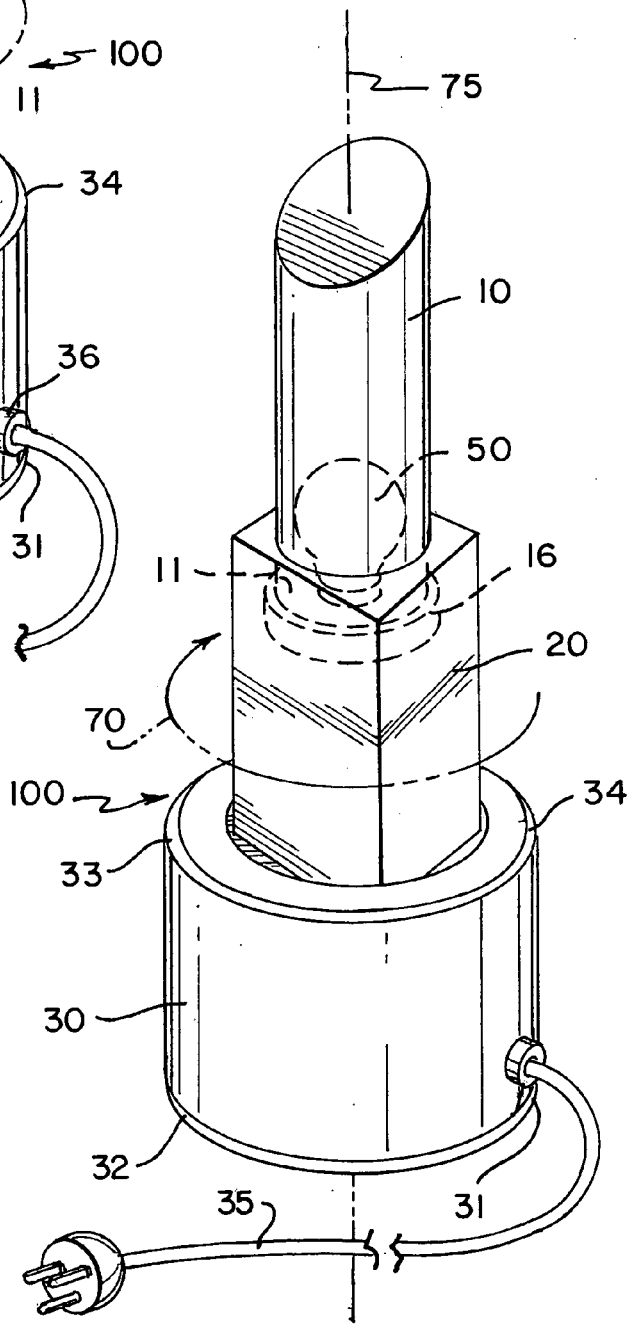
FIG. 2 is a perspective view illustrating the adjustable lamp of FIG. 1 with the shade in a projecting position along the linear axis in response to a rotation of the intermediate spacer.

The intermediate spacer 20 defines an interior region 27 which is shaped and sized to receive the coupling 40, which is housed therein, as well as the shade 10, when the shade 10 is in a retracted position (as shown in FIG. 1). Preferably, the spacer 20 is an elongated tubular body having an outer surface 22 which is cylindrical in shape. In another embodiment, the spacer 20 has an outer surface 22 which is rectangular in shape. The outside surface of the spacer 22 is sized and contoured so as to emulate the appearance of a traditional lipstick applicator and lipstick when combined with the remaining elements of the lamp.

The lamp 100 also includes a light source 50. The light source 50 is preferably a light bulb of any of a variety of known wattages and colors. Variations in desired brightness, color, and diffusion will motivate a user's selection of the light source 50. The light source 50 is connected to an electrical power source (not shown) through a power cord 35. The light source 50 is wholly contained within a shade 10 and preferably remains seated on the floor 11 of the shade 10 during operation of the lamp 100. In this way, as the shade 10 moves up and down along the linear axis 75 in response to a rotation of the intermediate spacer 20, the light source 50 similarly moves up and down long the linear axis 75. In another embodiment, the light source 50 is supported by the coupling 40 and does not move linearly up and down with the shade 10.

The light source 50 is preferably controlled by an on/off switch (not shown). In this manner, the light source 50 can be energized or de-energized regardless of the position of the shade 10. Thus, at an infinite number of positions along the linear axis 75, the light source 50 can emit light. According to another embodiment, the brightness of the light source can be varied with the motion of the shade such that relative linear movement of the light source 50 relative to the base 30 along the axis 75 causes the light source 50 to vary in intensity. In this manner, for example, moving the light source 50 along the axis 75 to a location of maximum extension from the base 30 (shown as line 150) can cause the light source to emit a maximum brightness, while moving the light source 50 along the axis 75 to a location of minimum extension from the base 30 (shown as line 125) can cause the light source to de-energize and emit no light, and moving the light source 50 along the axis 75 to any location in between can result in a relative brightness determined by the distance from the location of minimum extension (125). Other arrangements are also possible within the spirit of the present invention.

The lamp 100 also includes a shade 10 which is constructed from any of a variety of partially translucent materials and which acts to diffuse the light emanating from the wholly contained light source 50. Additionally, the shade 10 can be formed or painted in any of a variety of colors to simulate the appearance of colored lipstick. Preferably, the shade 10 is made from precision molded colored plastic, but it may also be made from any of a variety of translucent materials which are known and utilized in the fabrication of lamps. In one embodiment, the shade 10 is made from woven fabric of a particular color and pattern. In another embodiment, the shade 10 is made from non-woven fabric. Preferably, and for ease of manufacture and construction, the shade 10 can be made of the same material used to construct the base 30 and the spacer 20.

In one embodiment, the shade 10 has an open top surface 14 through which light emanating from the light source 50 freely exits the shade 10. The shade 10 also has an open interior section 13 that wholly contains the light source 50 and a floor 11 on which the light source 50 preferably rests. In one embodiment, a power cord 35 electrically connects the light source 50 to the power source (not shown) by passing through a through-hole 12 formed in the floor 11 of the shade 10.

The top surface of the shade 10 of the illustrated embodiment is contoured so as to simulate the appearance of a lipstick. As such, the surface may take any of a variety of contours indicating the appearance of a lipstick to one viewing the lamp 100, including, among others, an angled top edge having a sharp point 14, simulating an unused lipstick, or a curved and rounded top edge 15, simulating a worn-down and used lipstick.

The lamp 100 also includes a coupling 40 which is housed within the intermediate spacer 20. The coupling 40 interacts both with the intermediate spacer and the shade 10 so as to translate rotational motion of the spacer 20 into linear motion of the shade 10. The coupling is further connected to the base 30 by means of a projecting element 37 projecting from the base 30 and received by the coupling 40 such that the coupling 40 is restrained but can still move along the linear axis 75 relative to the base 30.

The shade 10 is moveable upwardly and downwardly along the linear axis 75 in response to a rotation of the intermediate spacer 20. Preferably, the linear axis 75 is substantially perpendicular to the axis of rotation 70. The coupling 40 may be a screw gear, a worm gear, or any of a variety of other mechanical arrangements capable of translating rotational motion of one element into linear motion of another. In one embodiment, rotation of the spacer 20 along one of a clockwise or counter-clockwise direction along the axis 70 causes the coupling 40 to raise upwardly from the base 30 along the linear axis 75, while rotation of the spacer 20 in the opposite direction causes the coupling 40 to move linearly in the opposite direction along the axis 75. In another embodiment, rotation of the spacer 20 in either of a clockwise or counter-clockwise direction causes the coupling 40 to raise upwardly from the base 30 along the linear axis 75 until a maximum extended distance of the coupling 40 is achieved (shown as line 150), after which point continued rotation in the same direction causes the coupling 40 to lower downwardly toward the base 30 along the linear axis 75 until a position of minimum extension is reached (shown as line 125).

According to one embodiment, when the lamp 100 is to be used, the intermediate spacer 20 is twisted along its axis of rotation 70 by a user in a single direction which causes both the coupling 40 and the shade 10 to raise upwardly relative to the base 30 along the linear axis 75. A user can continue rotating the spacer 20 until a desired extension of the shade 10 is achieved. According to another embodiment, rotation of the spacer 20 by a motor (20) controlled by the user causes both the coupling 40 and the shade 10 to raise upwardly relative to the base 30 along the linear axis 75 until the desired extension is achieved.

While the invention has been described in connection with certain preferred embodiments thereof it is not limited to such embodiments but rather is defined by the scope of the claims appended hereto.

I claim:

1. A lamp for use on a table or floor, comprising:

a base;

an intermediate spacer rotatably coupled to said base;

a light source;

a shade disposed over and about the light source, wherein said shade comprises a surface being shaped to suggest a lipstick, and wherein said shade further comprises a partially translucent portion that diffuses light from the light source that emanates from the lamp; and a coupling within the intermediate spacer, the coupling having a first portion coupled to the intermediate spacer and a second portion moveable in a linear axis in response to any rotation of the intermediate spacer so as to impart a linear motion to the shade.

2. The lamp of claim 1, wherein said shade is at least partially seated within the intermediate spacer.

3. The lamp of claim 1, wherein said shade comprises one of a woven fabric, a non-woven fabric and a polymer.

4. The lamp of claim 1, wherein said base further includes a power cord electrically connected to said light source.

5. The lamp of claim 1, wherein said intermediate spacer is an elongated tube.

6. The lamp of claim 5, wherein said elongated tube is a cylinder.

7. The lamp of claim 5, wherein said elongated tube is a box cylinder.

8. The lamp of claim 1, wherein a rotation of the intermediate spacer in a clockwise direction causes said shade to move along the linear axis in a first direction and rotation of the intermediate spacer in a counter-clockwise direction causes said shade to move along the linear axis in a second direction opposite to said first direction.

9. The lamp of claim 1, wherein a rotation of the intermediate spacer in one of a clockwise or counter-clockwise direction causes said shade to move along the linear axis in a first direction and a second direction opposition to said first direction.

10. The lamp of claim 1, wherein the intermediate spacer is further coupled to a motor for rotating the spacer.

11. The lamp of claim 1, further comprising retaining means to enable the shade to remain stationary in a fixed location along the linear axis.

12. A method of adjusting a light pattern emanating from a lamp, comprising the steps of:

providing a lamp having a base, an intermediate spacer rotatably coupled to said base, a light source, a shade having a surface shaped to suggest a lipstick, and a coupling within the intermediate spacer, the coupling having a first portion coupled to the intermediate spacer and a second portion moveable in a linear axis in response to any rotation of the intermediate spacer so as to impart a linear motion to the shade;

energizing the lamp;

rotating the intermediate spacer; and moving the shade from a first position to a second position along the linear axis while maintaining the light source energized, whereby the pattern of light emanating from the lamp is adjusted.

* * * * *